US007588040B1

(12) United States Patent
Chen et al.

(10) Patent No.: US 7,588,040 B1
(45) Date of Patent: Sep. 15, 2009

(54) GOLF UMBRELLA COMBINED WITH A SPARE GOLF BALL

(76) Inventors: Jung-Yuan Chen, 2F-1, No. 152, Nan Ya Street, Hsinchu City (TW); Michael Chien-Lung Wu, 2F-1, No. 152, Nan Ya Street, Hsinchu City (TW)

( * ) Notice: Subject to any disclaimer, the term of this patent is extended or adjusted under 35 U.S.C. 154(b) by 0 days.

(21) Appl. No.: 12/078,883

(22) Filed: Apr. 8, 2008

(51) Int. Cl.
*A45B 9/02* (2006.01)

(52) U.S. Cl. ..... 135/16; 135/25.4; 473/282; 294/19.2

(58) Field of Classification Search ..... 135/16, 135/15.1, 25.4, 44, 48, 17; 248/538, 541; 294/19.2; 473/282, 285–286
See application file for complete search history.

(56) References Cited

U.S. PATENT DOCUMENTS 1,830,520 A * 11/1931 Moyses ..... 294/19.2
2,819,108 A * 1/1958 Borah ..... 294/19.2
4,733,681 A * 3/1988 Lee ..... 135/16
5,337,771 A * 8/1994 Berges et al. ..... 135/25.4
5,361,793 A * 11/1994 Stahnke ..... 135/65
5,437,488 A * 8/1995 Richmond et al. ..... 294/19.2
5,476,113 A * 12/1995 Lin et al. ..... 135/16
6,045,288 A * 4/2000 Pasternak et al. ..... 403/109.3
6,095,168 A * 8/2000 Berges ..... 135/16
6,409,611 B1 * 6/2002 Louk, Jr. ..... 473/286
6,447,407 B1 * 9/2002 Caldwell ..... 473/408
6,510,861 B1 * 1/2003 Mead ..... 135/16
6,852,040 B1 * 2/2005 Williams ..... 473/286
2004/0099295 A1 * 5/2004 You ..... 135/16

* cited by examiner

*Primary Examiner*—Winnie Yip
(74) *Attorney, Agent, or Firm*—Leong C. Lei

(57) ABSTRACT

A kind of golf umbrella combined with a spare golf ball is mainly set with an assembling mechanism in the end of the handle of a golf umbrella. One lower end of the said assembling mechanism can be simply and firmly set on the handle with ease and it is set with a hemisphere sleeve-fit body to provide a temporary holding of a golf ball. Therefore, it becomes a last spare ball while playing golf and the practical value is thus obtained.

1 Claim, 7 Drawing Sheets

GOLF UMBRELLA COMBINED WITH A SPARE GOLF BALL

BACKGROUND OF THE INVENTION

The golf playing has become a very popular and vogue entertainment and is fond of by many people. However, the playing skills are different among people, and the losing of golf balls is also very ordinary. In general, people will all carry the spar golf balls. However, in some circumstance, there are chances of being not enough for usage. Therefore, for experienced people, one to two golf balls are hand carried generally to be used in emergency conditions. Up to now, the spare balls are known to put in the pockets. However, the golf balls are equipped with certain volumes and weights, thus are not easy to be hand carried.

SUMMARY OF THE INVENTION

Hereafter, the present invention mainly is to design a kind of structure in the golf umbrella to provide a simple and convenient way for assembling the spare golf balls and make it convenient to carry. The golf umbrella is a required dunnage while playing golf, thus there will be no increasing load. That is, the special design present invention has achieved the innovativity and progressiveness and thus conformed to the requirements of the new patents. The structures of the present invention will be described hereafter by referring to the following drawings.

DETAILED DESCRIPTION OF THE PREFERRED EMBODIMENT

Figure 1:
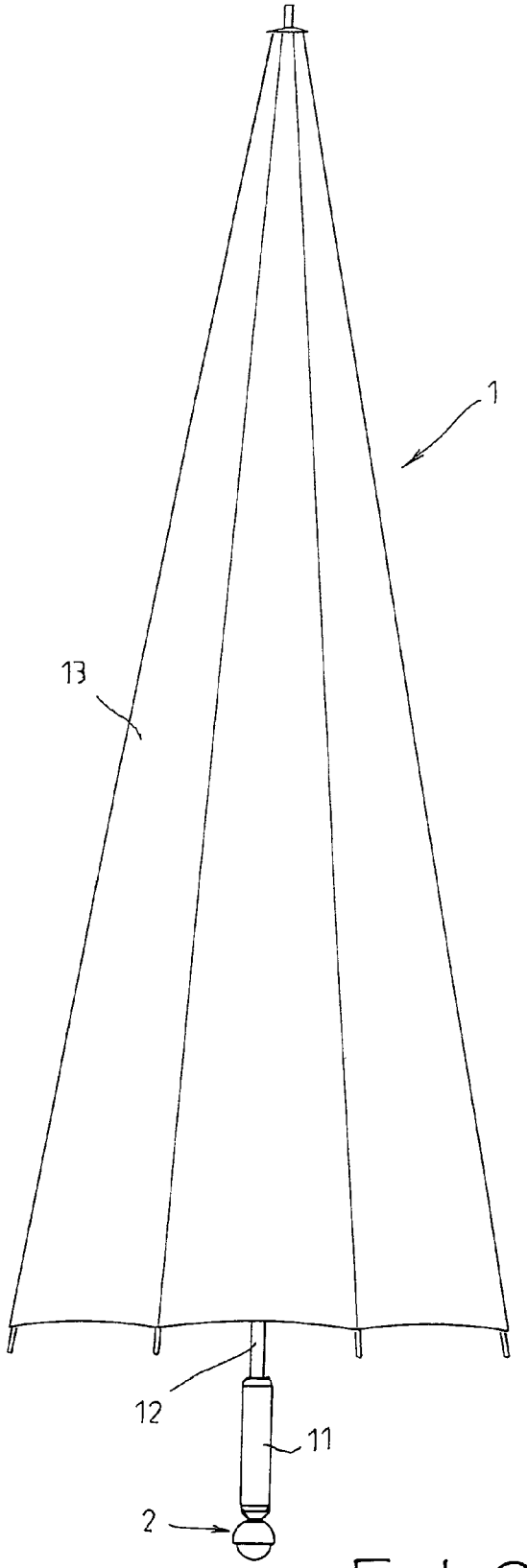
FIG. 1 is a plan drawing of the present invention.
Figure 2:
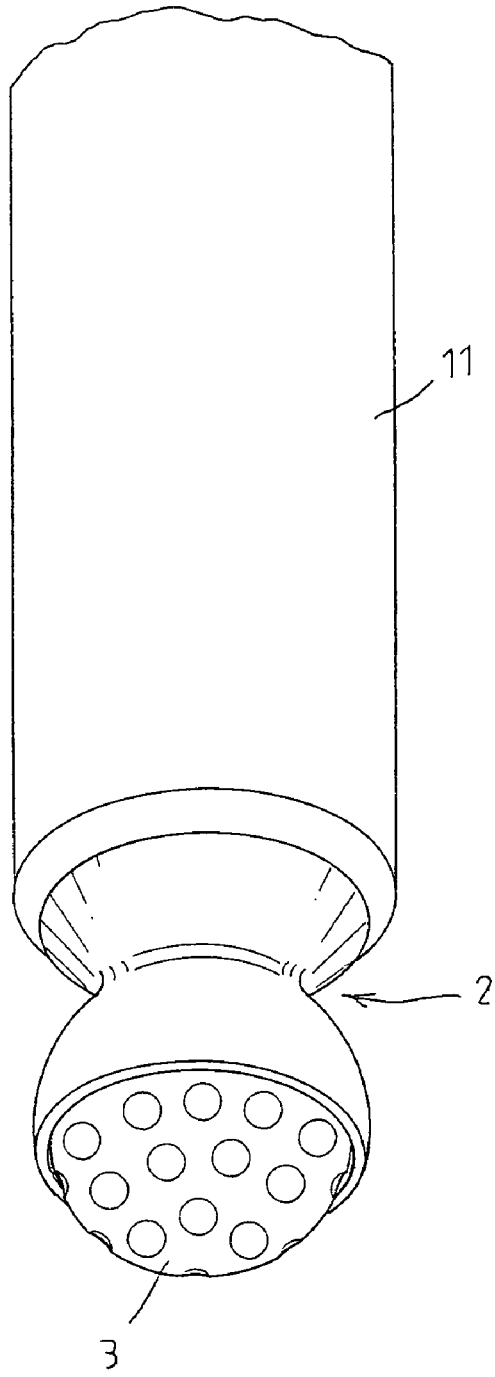
FIG. 2 is a three-dimensional enlargement drawing of a portion of the present invention.
Figure 3:
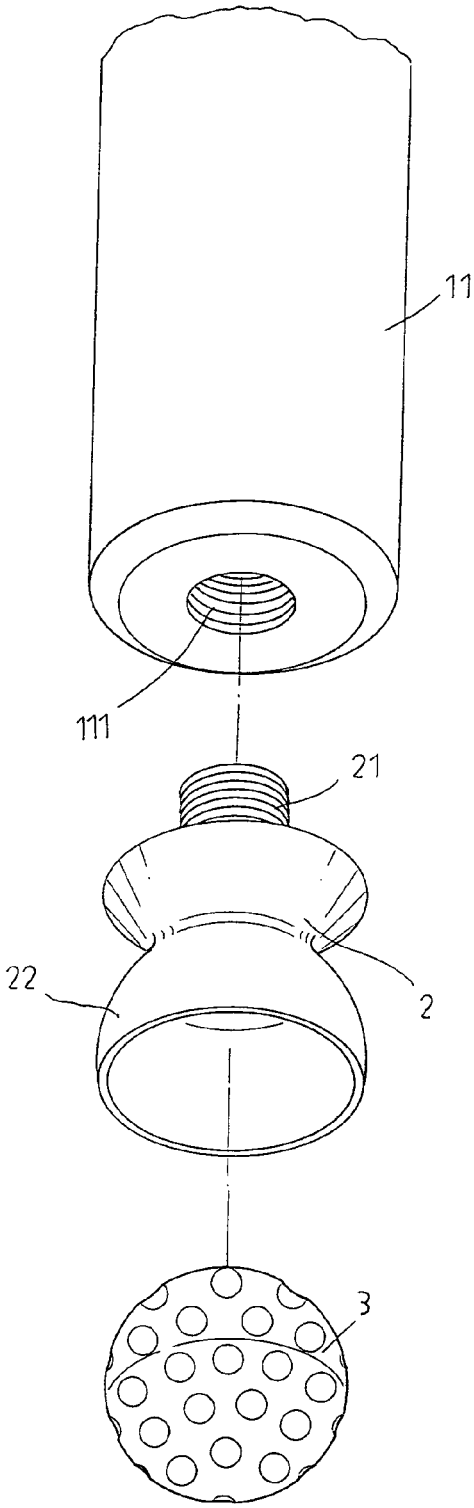
FIG. 3 is an analytic drawing of FIG. 2.

At first, please refer to FIG. 1. The present invention is an improved golf umbrella (1), which includes a handle (11), a middle keel (12) and an umbrella cover (13) and is characterized in that a golf ball holder (2) is provided in the lower end of the handle (11). As shown in FIGS. 2 and 3, the. The hemispherical portion (22) thus can provide a temporary holding with the golf ball, and the ball can be taken out for use at any moment.

Figure 4:
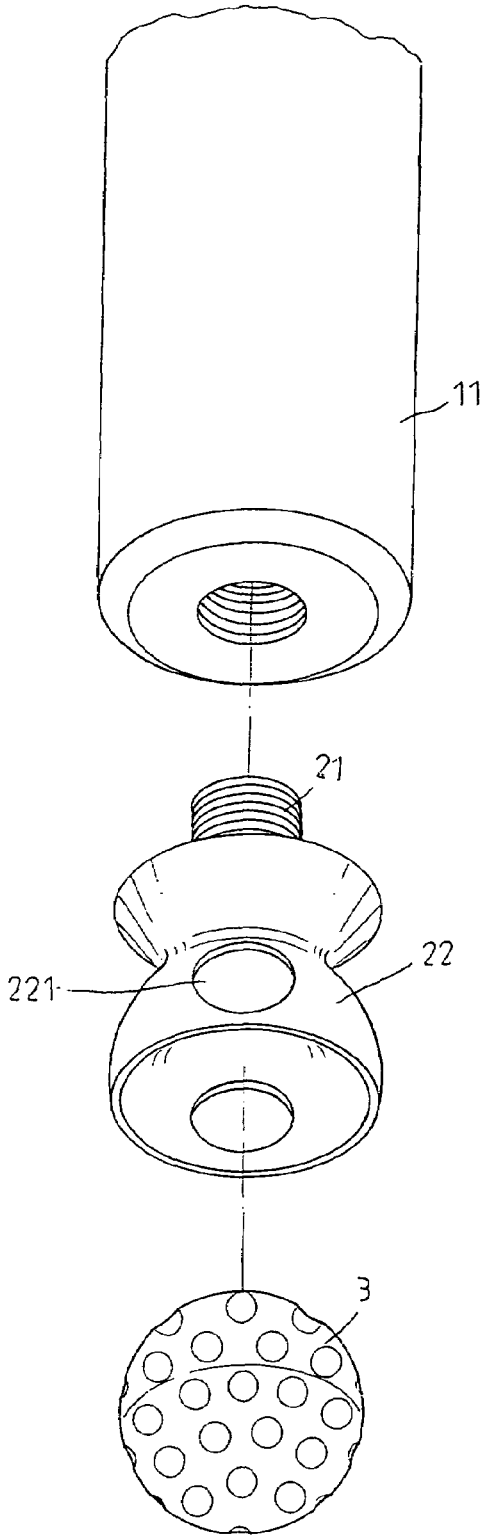
FIG. 4 is a variational structural drawing of FIG. 3.
Figure 5:
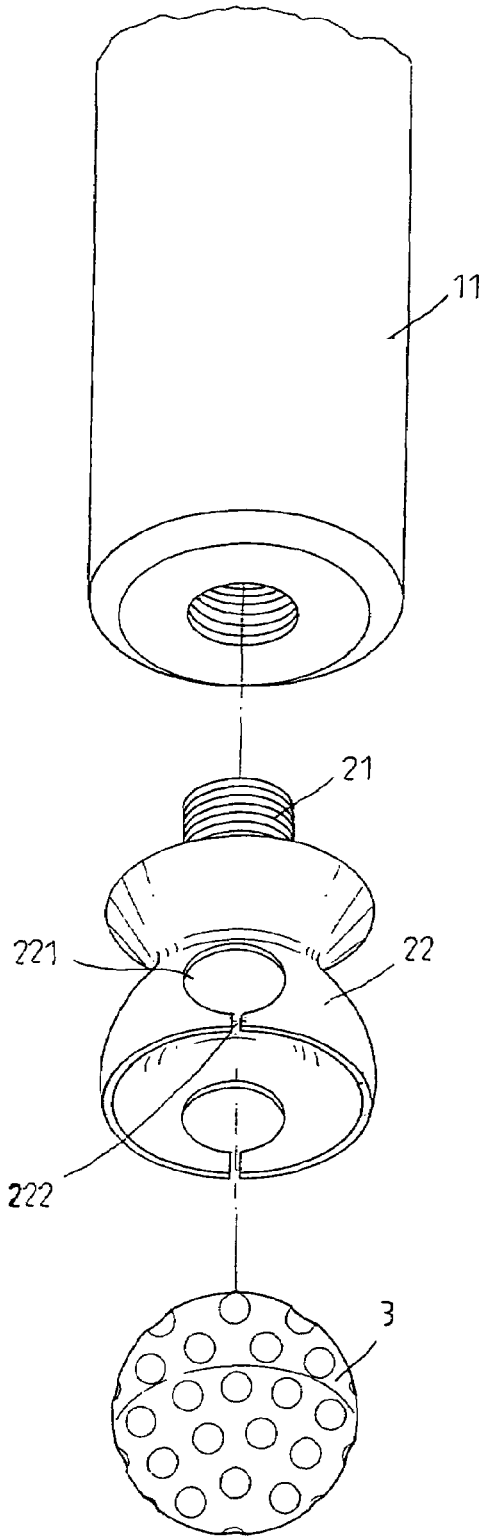
FIG. 5 is a variational structural drawing of FIG. 4.

Please refer to FIG. 4. The shell side of the hemispherical portion (22) in the present invention can be further formed with two circular openings (221) for forcing out the golf ball (3) conveniently. As also shown in FIG. 5, two slits (222) are formed on the circular openings (221) of the hemispherical portion (22). The width of the slit (222) is smaller than the diameter of the circular opening (221) and extends from the circular opening (221) to the bottom edge of the hemispherical portion (22).

Figure 6:
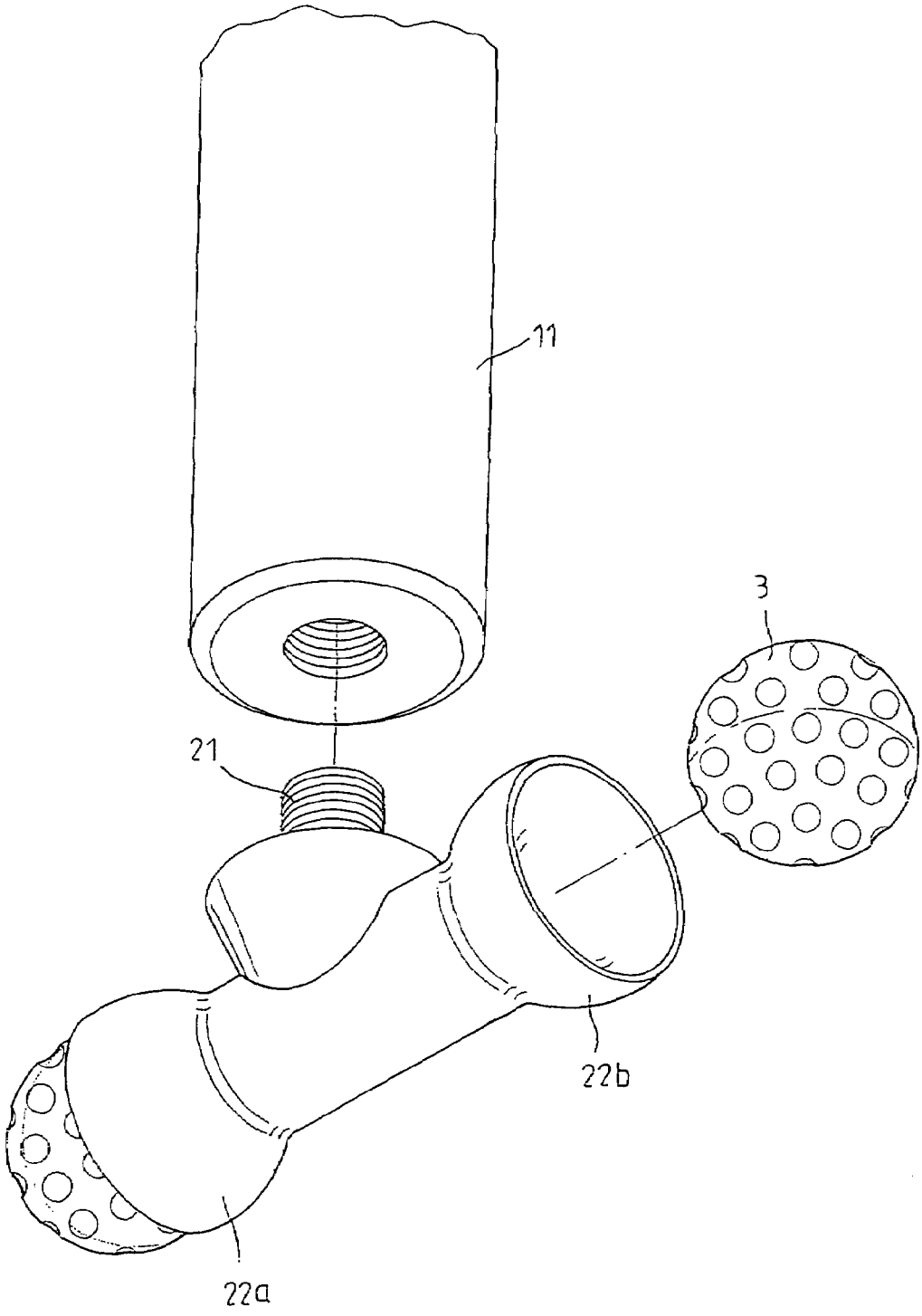
FIG. 6 is a structural drawing of another embodiment of the present invention.
Figure 7:
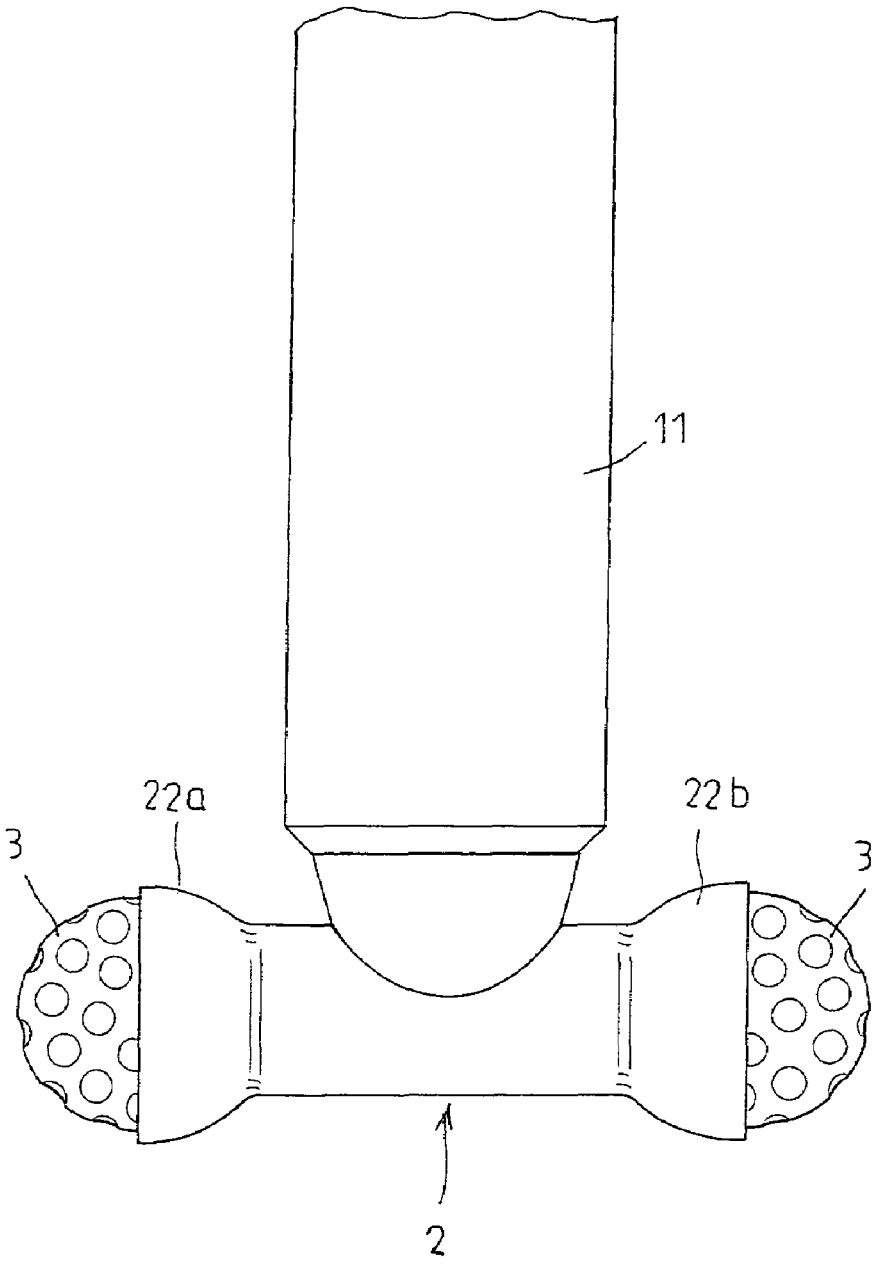
FIG. 7 is an assembling plan drawing of FIG. 6.

Please refer to FIGS. 6 and 1, the golf ball holder (2) in the present invention includes a threaded portion (21), and is furthermore formed with two hemispherical portions (22*a*) and (22*b*) in the extending of its two sides. The two hemispherical portions (22*a*) and (22*b*) can temporarily assemble with the golf balls (3), and thus can reach a purpose of the provision of holding two spare golf balls. By summarizing the aforementioned description, the present invention should have conformed to the requirement for patent approval and we thus file the application according the law. And the about mentioned embodiment is only exemplary and is not to limit the scope of the invention. Any modification with the same merit will be still claimed in the present invention.

The invention claimed is:

1. In a golf umbrella comprising a handle, a middle keel and an umbrella cover, the improvement wherein said handle has a lower end provided with a threaded hole, a golf ball holder having an upper end provided with a threaded portion engageable with said threaded hole of said handle, said golf ball holder having a lower end provided with a hemispherical portion which is open at a bottom thereof, said hemispherical portion having a shell side being formed with two circular openings for enabling said golf ball to be forced out by fingers of a user, two slits each having a width smaller than diameter of said circular openings and extending from a respective one of said circular openings to a bottom edge of said hemispherical portion.

* * * * *